United States Patent [19]

Stevens

[11] Patent Number: 4,614,050

[45] Date of Patent: Sep. 30, 1986

[54] PROTECTIVE SHUTTER WITH CLEANING APERTURE FOR PORTABLE LASERBEAM AIMING DEVICE

[75] Inventor: Frederick G. Stevens, Bridgeport, Conn.

[73] Assignee: Hydra Systems International, Inc., Bridgeport, Conn.

[21] Appl. No.: 625,128

[22] Filed: Jun. 27, 1984

[51] Int. Cl.[4] ..... F41G 1/04; F41G 11/00

[52] U.S. Cl. ..... 42/1.01; 42/100; 350/586

[58] Field of Search ..... 42/1 A, 1 S; 350/586, 350/319; 372/109; 362/321; 354/222

[56] References Cited

U.S. PATENT DOCUMENTS 2,475,942 7/1949 Brown ..... 354/222

2,879,379 3/1959 Lyons ..... 362/321

4,079,534 3/1978 Snyder ..... 42/1 A

*Primary Examiner*—Deborah L. Kyle

*Assistant Examiner*—Michael J. Carone

*Attorney, Agent, or Firm*—Kramer and Brufsky

[57] ABSTRACT

A substantially flat shutter plate is mounted for sliding movement on a shutter mounting means secured to the front of a laser aiming device housing. The shutter plate is substantially L-shaped to provide a fingerpull by contact with the shorter leg of the "L" and is slidable within a track formed in the rear surface of the mounting means, and includes in tandem, a first opening, a second opening and a solid portion, which can be used to aim a laser beam emitted from the laser aiming device housing, clean the laser tube, and shut the housing, respectively.

7 Claims, 10 Drawing Figures

PROTECTIVE SHUTTER WITH CLEANING APERTURE FOR PORTABLE LASERBEAM AIMING DEVICE

BACKGROUND OF THE INVENTION

This invention relates to weapons, such as firearms which are laser aimed, and more particularly, relates to a protective shutter for use with a laser gunsight or aiming device for selective opening and closing of the device. The shutter enables the gunsight to be readily used and cleaned, while protecting it against impingement by foreign debris when not in use.

Laser aiming devices for firearms are well known. Examples of such devices are disclosed in U.S. Pat. Nos. 4,152,754; 4,233,770; 4,313,272; and 4,313,273. In each of the devices disclosed in these patents, a laser beam is emitted to impinge upon a target to light the target and automatically aim the weapon on which it is mounted. The laser gunsight is removably mounted on the weapon and includes a laser tube which emits a beam from an opening in the laser tube housing to impinge upon the target. The housing contains a power source, such as one or more batteries, for powering the laser.

The opening in the housing in communication with the laser tube is usually open and debris and other foreign material can enter the housing and the laser tube, raising the probability of possible malfunction. However, an opening must be left in the housing through which the laser beam can be emitted to impinge upon the target and to provide access to the interior of the tube from the exterior of the housing in order that the tube may be cleaned utilizing an appropriate solvent.

The present invention provides a shutter attachment secured to the laser gunsight housing which enables the laser emitting opening in the housing to be uncovered when it is desired to be used, access to the interior of the housing for cleaning the laser tube, and a cover to preclude communication between the exterior and interior of the housing when the aiming device is not in use to preclude extraneous and foreign debris from entering the housing from the ambient exterior.

SUMMARY OF THE INVENTION

In accordance with the invention, a substantially flat shutter plate is mounted for sliding movement on a shutter mounting means or frame consisting of a diamond-shaped plate secured to the front of the laser aiming device housing.

The diamond-shaped mounting plate has an opening in registration with the laser beam emitting opening in the housing behind which is mounted a laser tube. The shutter plate is substantially L-shaped to provide a fingerpull by contact with the shorter leg of the "L" and is slidable within a track formed in the rear surface of the diamond-shaped mounting plate. The track in the rear of the diamond-shaped mounting plate and longer of the two perpendicular legs of the L-shaped shutter plate are provided with abutment shoulders to preclude disassociation of the shutter plate from the mounting plate upon sliding of the shutter plate relative to the frame.

The shutter plate is provided with a first opening, smaller in diameter than the aligned registered openings in both the mounting plate and housing adjacent the laser emitting tube. This first opening when placed in registration with the openings in the housing and mounting plate provides a smaller aiming opening for the beam emitted by the laser which impinges upon a target. This reduces visibility of the laser beam spot on the target from other portions of the field and reduces the chance of location of a soldier whose weapon is equipped with the laser aiming device. A second opening is provided in the shutter plate which is adapted to be placed in registration with the opening in the mounting plate and housing. The second opening is substantially of the same diameter as the openings in front and in back of it and provides ready access therethrough to the laser tube within the housing for cleaning with an appropriate solvent and swab. Finally, the shutter plate is provided with a solid portion, defining a third position, which can be positioned between the opening in the diamond-shaped mounting plate and opening in the housing to close communication between the ambient exterior of the housing and the interior thereof, in order to preclude debris and other foreign material from entering the housing and laser tube when the aiming device is not in use.

A collar is also provided on one end of the laser tube in the housing. The collar has a spring-biased pin extending from the front surface thereof through the front of the laser aiming device housing. The rear surface of the shutter plate is provided with three spaced detents which are adapted to be placed in mating engagement with the spring biased pin as the various aiming, cleaning, and closed positions of the shutter plate are interchangeably attained to lock the shutter plate in the selected first, second or third position. The spring pressure on the detent mounted on the collar can be adjusted to assure proper seating of the detent within the appropriate opening in the rear of the shutter plate.

The rear surface of the shutter plate is also provided with an indicator mark visible to the user of the laser aiming device only when the shutter plate is in its first position or aiming position to indicate to the user that the shutter plate is in such a position and the weapon is now ready for firing at the target. The indicator means can be provided in the nature of a machined spot on the rear surface of the shutter plate which can be painted a suitable color and located on the rear surface in such a position that it is only visible to the weapon firer when the shutter plate has been extended beyond one edge of the housing of the laser aiming device, thereby indicating that the first opening in the shutter plate is aligned and in registration with the laser beam emitting opening in the housing and the opening in the diamond-shaped mounting plate.

The shutter arrangement described is compact and not bulky, wherein it does not add to the weight of the laser aiming device or weapon, nor mechanically interferes with the weapon's functioning.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
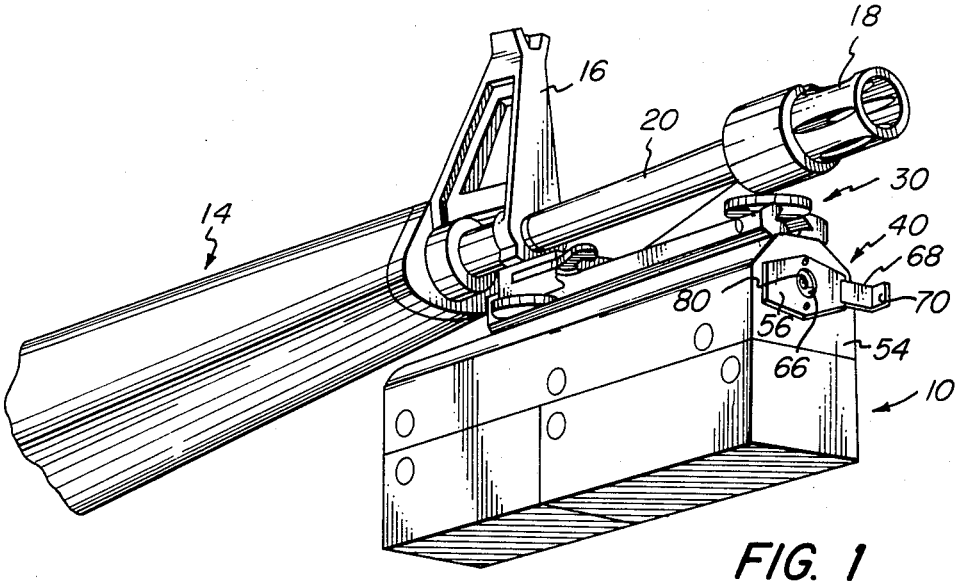
FIG. 1 is a perspective view of a laser aiming device provided with the protective shutter of the present invention, mounted on a weapon.

Referring now to the drawings in detail, wherein like numerals indicate like elements throughout the several views, a laser gunsight or aiming device generally designated by the numeral 10 is shown in FIG. 1 as being mounted on the barrel 20 of a weapon 14 by a mount generally designated by the numeral 30 between the flash suppressor 18 and bayonet holder 16 of weapon 14.

Examples of the laser gunsight 10 are disclosed in detail in U.S. Pat. Nos. 4,152,754; 4,233,770; 4,313,272; and 4,313,273, which disclosures are incorporated herein by reference. The mount 30 used to mount the laser gunsight 10 barrel 20 of weapon 14 between flash suppressor 18 and bayonet holder 16 is illustrated in detail in U.S. Pat. Nos. 4,494,328 and 4,539,769, assigned to the same assignee as the present invention. The details of the mount 30 are also incorporated herein by reference, as disclosed in the cited patent applications.

Generally however, laser gunsight 10 includes a laser tube 52 which emits a laser beam to impinge upon a target from an opening 12 in the front cover 54 and includes a self-contained power source, such as batteries (not shown), for exciting the laser.

The protective shutter 40 of the present invention is mounted on the front cover 54 of laser gunsight 10 and includes a fixed diamond-shaped mounting plate 56 secured to cover 54 by threaded fasteners 58, 60 received through openings 62 and threaded into threaded openings 64 in cover 54. Plate 56 has an opening 66 in registration with the laser beam emitting opening 12 in the housing 10 behind which is mounted laser tube 52.

A substantially L-shaped shutter plate 68, providing a fingerpull by contact with the shorter leg 70 of the "L", is slidable within a track 72 formed in the rear surface of the diamond-shaped mounting plate 56. The track 72 in the rear of the diamond-shaped mounting plate 56 and the longer one 74 of the two perpendicular legs 70, 74 of the L-shaped shutter plate are provided with abutment shoulders 76, 78 to preclude disassociation of the shutter plate 68 from the mounting plate 56 upon sliding of the shutter plate relative to the mounting plate.

The shutter plate 68 is provided with a first opening 80, smaller in diameter than the aligned registered openings 66, 12 in both the mounting plate 56 and housing cover 54, respectively, the latter being adjacent the laser emitting tube 52. This first opening 80 when placed in registration with the openings 66, 12 provides a smaller aiming opening for the beam emitted from the laser tube 52 which impinges upon a target. This reduces visibility of the laser beam spot on the target from other portions of the field and reduces the chance of location of a soldier whose weapon is equipped with the laser aiming device 10.

A second opening 82 is provided in the shutter plate 68 which is adapted to be placed in registration with the openings 66 and 12 in the mounting plate 56 and housing cover 54, respectively. The second opening 82 is substantially of the same diameter as the openings 66, 12, in front and in back of it and provides ready access therethrough to the laser tube 52 within the housing 10 for cleaning with an appropriate solvent and swab.

Finally, the shutter plate is provided with a solid portion 84, defining a third position, which can be positioned between the opening 66 in the diamond-shaped mounting plate 56 and the opening 12 in the housing cover 54 to close communication between the ambient exterior of the housing and the interior thereof, in order to preclude debris and other foreign material from entering the housing and laser tube 52 when the aiming device is not in use.

A collar 86 is also provided on one end of the laser tube 52 in the housing. The collar 86 has a spring-biased pin or detent 88 extending from the front surface thereof through an opening 90 in the cover 54 of the laser aiming device housing. The rear surface of the shutter plate is provided with three spaced openings 92, 94 and 96 which are adapted to be placed in mating engagement with the spring biased pin or detent 88 as the various aiming, cleaning, and closed positions of the shutter plate 68 are interchangeably attained to lock the shutter plate 68 in the selected first, second or third positions. The spring pressure on the detent 88 mounted on the collar 86 can be adjusted to assure proper seating of the detent 88 within the appropriate opening 92, 94 and 96 in the rear surface of the shutter plate, 68 by rotating, tightening or loosening a screw 98 on which coil spring 100 is mounted behind pin 88; the entire assembly of the components 98, 100, and 88 being housed within an internally and externally threaded tube 102 secured within threaded opening 104 provided on the circumference of collar 86.

Figure 2:
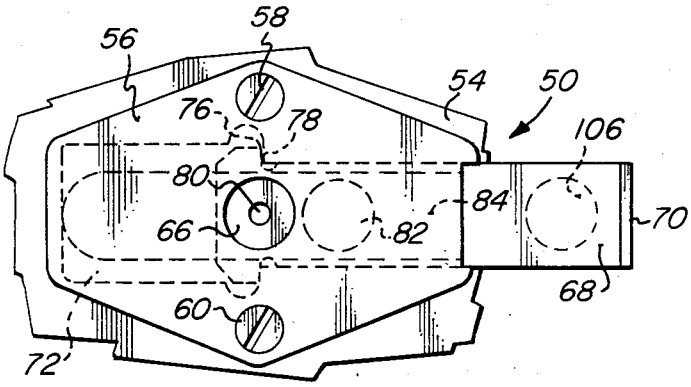
FIG. 2 is a front view in elevation of the shutter illustrated in FIG. 1 in a first position wherein the aiming opening is in registration with the laser beam emitting opening in the laser aiming device housing.
Figure 3:
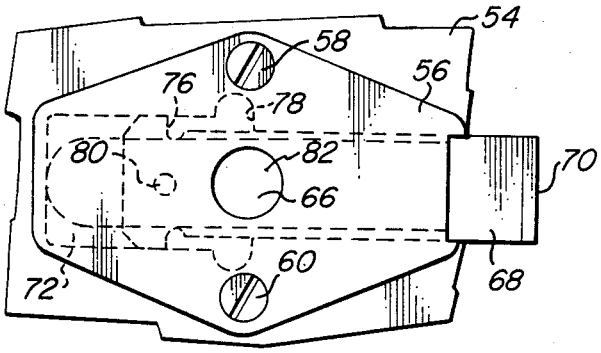
FIG. 3 is a view similar to FIG. 2, but with the protective shutter plate moved to a position wherein a second, larger opening is placed in registration with the aperture in the laser aiming device housing so that the laser tube within the housing is accessed for cleaning.
Figure 4:
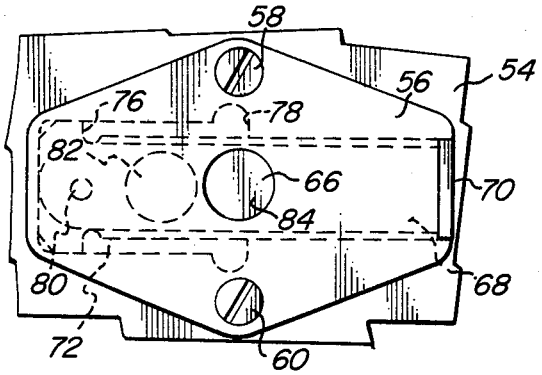
FIG. 4 is a view similar to FIGS. 2 and 3 but illustrating yet a third position of the shutter plate of the protective shutter mounted on the laser aiming device housing wherein a solid portion of the shutter plate closes the aperture in the laser aiming device housing.
Figure 5:
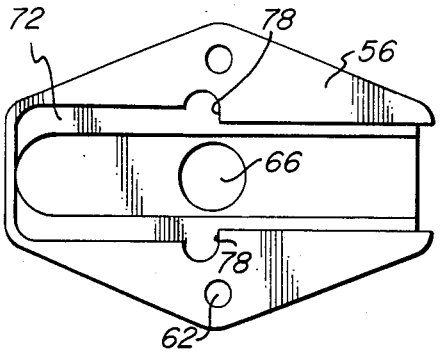
FIG. 5 is a rear view in elevation of the shutter mounting plate illustrated in FIGS. 1 through 4, inclusive.
Figure 6:
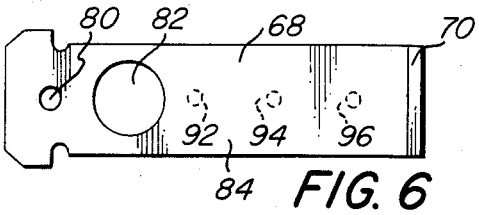
FIG. 6 is a front view in elevation of the shutter plate illustrated in FIGS. 1 to 4, inclusive, of the protective shutter mounted on the laser aiming device housing.
Figure 7:
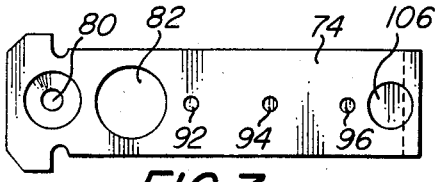
FIG. 7 is a rear view in elevation of the shutter plate of FIG. 6.
Figure 8:
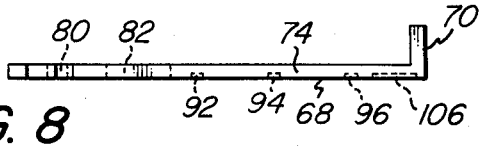
FIG. 8 is a top plan view of the shutter plate of FIG. 7.
Figure 9:
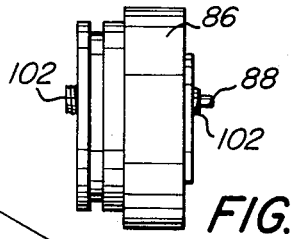
FIG. 9 is a side view in elevation of a collar mounted on the laser tube within the housing of the laser aiming device which includes a spring biased pin extending from its front surface which protrudes through the front of the laser aiming device housing for locking engagement with the shutter plate of FIGS. 6 to 8, inclusive.
Figure 10:
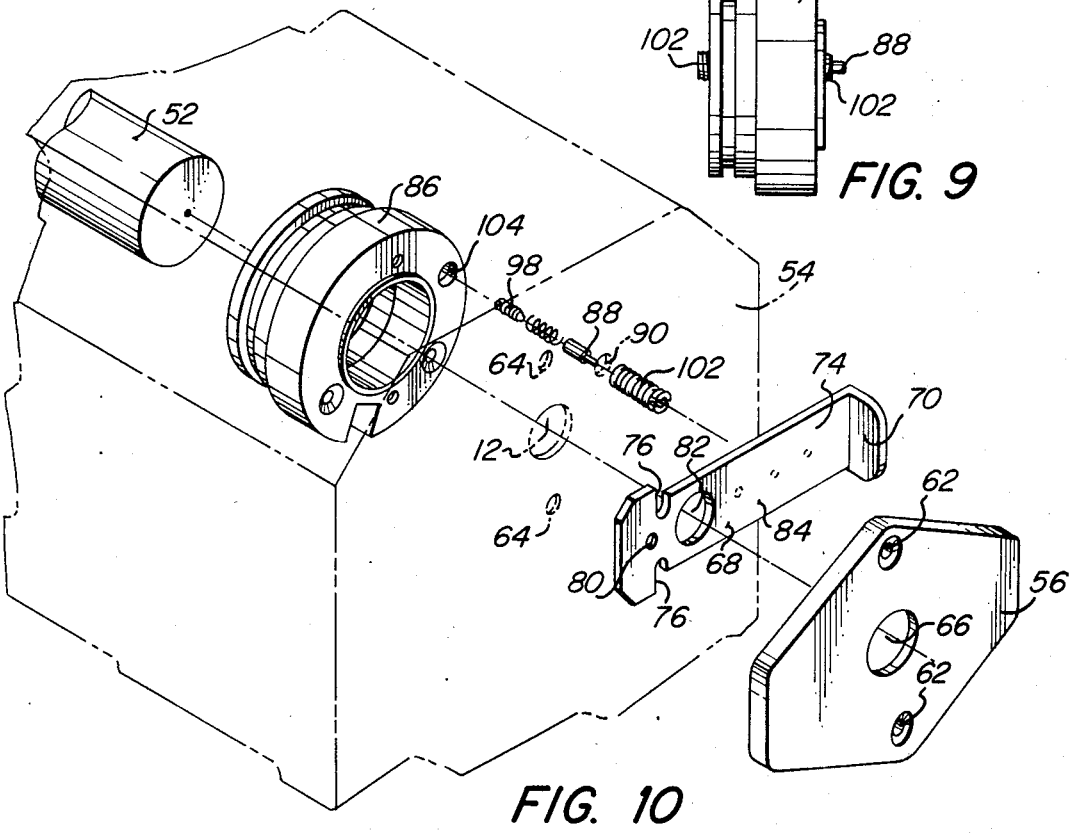
FIG. 10 is an exploded perspective view of the protective shutter components comprising the subject of the present invention.

The rear surface of the shutter plate 68 is also provided with an indicator means 106 visible to the user of the laser aiming device 10 only when the shutter plate 68 is in its first position or aiming position, as shown in FIGS. 1 and 2 to indicate to the user that the shutter plate 68 is in such a position and the weapon is now ready for firing at the target. The indicator means 106 can be provided in the nature of a machined circular spot on the rear surface of the shutter plate which can be painted a suitable color (or simply a colored mark) and located on the rear surface in such a position that it is only visible to the weapon firer when the shutter plate has been extended beyond one edge of the housing cover 56 of the laser aiming device 10, thereby indicating that the first opening 80 in the shutter plate 68 is aligned and in registration with the laser beam emitting opening 12 in the housing cover 54 and the opening 66 in the diamond-shaped mounting plate 56.

The shutter arrangement described is compact and not bulky, wherein it does not add to the weight of the laser aiming device 10 or weapon 14, nor mechanically interferes with the weapon's functioning.

What is claimed is:

1. A laser aiming device for attachment to a firearm comprising:

a housing having an aperture;

a laser mounted in said housing and oriented to emit a beam through said aperture; and shutter means for opening and closing said aperture including a substantially L-shaped shutter plate comprising a longer leg having an aiming opening, a larger cleaning opening and a solid portion, and a shorter leg adapted to provide a fingerpull, and a stationary frame comprising a track adapted to slidably receive and retain the larger leg of the shutter plate and mounted over said aperture for interchangeable movement from a first position where the aiming opening is in registration with said aperture, to a second position where the cleaning opening is in registration with said aperture, and to a third position where the solid portion is in registration with and closes the aperture.

2. The device of claim 1 wherein said shutter plate includes a shoulder extending therefrom and adapted to abut a stop in said track in the path of movement of said shutter plate to limit the sliding movement of the shutter plate within the track and thereby prevent removal of the shutter plate from said aiming device.

3. The device of claim 1 further comprising detent means for registration with and for maintaining said shutter plate in said first, second and third positions upon movement of the shutter plate to such positions.

4. The device of claim 3 further comprising indicator means for apprising a user of the device that the shutter plate is in said first position.

5. The device of claim 4 wherein said indicator means comprises a mark on said shutter plate which is visible only when the shutter plate is in said first position.

6. The device of claim 3 wherein said detent means comprises a spring loaded pin extending from said housing toward said shutter plate, together with first, second and third recesses in said shutter plate for engagement with said pin when said shutter plate is in said first, second and third positions, respectively.

7. The device of claim 6 further comprising means for adjusting the distance of extension of said pin from said housing.

* * * * *